US010161293B2

(12) United States Patent
Takizawa et al.

(10) Patent No.: US 10,161,293 B2
(45) Date of Patent: Dec. 25, 2018

(54) COOLING SYSTEM FOR INTERNAL COMBUSTION ENGINE

(71) Applicant: HONDA MOTOR CO., LTD., Tokyo (JP)

(72) Inventors: Takuo Takizawa, Wako (JP); Taichi Soga, Wako (JP); Hiroto Asano, Wako (JP); Yasuyoshi Matsumoto, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 21 days.

(21) Appl. No.: 15/660,257

(22) Filed: Jul. 26, 2017

(65) Prior Publication Data

US 2018/0030880 A1 Feb. 1, 2018

(30) Foreign Application Priority Data

Jul. 29, 2016 (JP) ..... 2016-150779

(51) Int. Cl.

| | |
|---|---|
| ***F01P 7/16*** | (2006.01) |
| ***F01P 3/02*** | (2006.01) |
| *F01P 11/16* | (2006.01) |
| *F01P 7/14* | (2006.01) |

(52) U.S. Cl.

CPC ..... *F01P 7/16* (2013.01); *F01P 3/02* (2013.01); *F01P 11/16* (2013.01);

(Continued)

(58) Field of Classification Search

CPC ..... F01P 7/16; F01P 3/02; F01P 11/16; F01P 2007/146

(Continued)

(56) References Cited

U.S. PATENT DOCUMENTS

2006/0042566 A1* 3/2006 Ito ..... F01P 7/16 123/41.08
2013/0032101 A1* 2/2013 Takeuchi ..... F01P 7/164 123/41.02

(Continued)

FOREIGN PATENT DOCUMENTS

JP H8-74575 A 3/1996
JP 2000-274244 A 10/2000

(Continued)

OTHER PUBLICATIONS

Decision to Grant a Patent, Japanese Patent Application No. 2016-150779, dated Jul. 3, 2018, 3 pages.

(Continued)

*Primary Examiner* — Syed O Hasan
(74) *Attorney, Agent, or Firm* — Armstrong Teasdale LLP

(57) ABSTRACT

An engine cooling system (2) includes a first passage (11) communicating a radiator (8) with a jacket inlet (7) of a water jacket of an engine, a second passage (13) communicating a jacket outlet (12) of the water jacket with the radiator, and a third passage (16) communicating a part of the second passage with a part of the first passage located between the radiator and the water pump. To allow the cooling water temperature circulating in a water jacket of an engine to be detected accurately, a water temperature sensor (72) is provided in a part of the second passage intermediate between the part of the second passage where the third passage branches off and the jacket outlet.

9 Claims, 9 Drawing Sheets

(52) U.S. Cl.
CPC ... *F01P 2003/028* (2013.01); *F01P 2007/146* (2013.01); *F01P 2025/32* (2013.01); *F01P 2060/04* (2013.01); *F01P 2060/045* (2013.01); *F01P 2060/08* (2013.01); *F01P 2060/16* (2013.01)

(58) Field of Classification Search
USPC ..... 123/41.02, 41.05, 41.44, 41.67, 41.72, 123/41.82 R
See application file for complete search history.

(56) References Cited

U.S. PATENT DOCUMENTS

| | | | | |
|---|---|---|---|---|
| 2016/0245150 | A1* | 8/2016 | Owaki | F01P 3/02 |
| 2017/0248064 | A1* | 8/2017 | Kudo | F01F 1/243 |

FOREIGN PATENT DOCUMENTS

| | | | |
|---|---|---|---|
| JP | 2008-223761 | A | 9/2008 |
| JP | 2010-174709 | A | 8/2010 |
| JP | 2012-184754 | A | 9/2012 |
| JP | 2013-108429 | A | 6/2013 |
| WO | 2013/137043 | A1 | 9/2013 |

OTHER PUBLICATIONS

Notice of Reasons of Rejection, Japanese Patent Application No. 2016-150779, dated Feb. 27, 2018, 5 pages.

* cited by examiner

COOLING SYSTEM FOR INTERNAL COMBUSTION ENGINE

TECHNICAL FIELD

The present invention relates to a cooling system for an internal combustion engine.

BACKGROUND ART

In the technical field of internal combustion engines, it is known to place a water temperature sensor downstream of an outlet of a water jacket formed in an engine main body. See US2006/0042566A1, for instance. In this prior art, a passage forming member internally defining both a passage leading to a radiator and a passage bypassing the radiator is attached to a cooling water outlet of an engine main body, and a water temperature sensor is positioned in a part of the passage forming member where the two passages branch off from each other.

However, when a water temperature sensor is provided in a branching part where a passage leading to the radiator and a passage bypassing the radiator branch off from each other, because the state of the water flow at the branching part may vary depending on if the cooling water is flowing into the radiator or if the water flow is bypassing the radiator, the accuracy of temperature detection may not be ensured depending on the situation. When the cooling water does not flow from the water jacket into the radiator, the cooling water held in the radiator and having a relatively low temperature may flow backward to the branching part so that the temperature detected by the water temperature sensor may be lower than the actual temperature of the cooling water flowing out of the water jacket.

SUMMARY OF THE INVENTION

In view of such a problem of the prior art, a primary object of the present invention is to provide an engine cooling system which allows the cooling water temperature to be detected accurately without regard to the operating condition of the cooling system.

The present invention achieves such an object by providing an engine cooling system, comprising: a water jacket (6) formed on a main body (5) of an internal combustion engine; a first passage (11) communicating a radiator (8) with a jacket inlet (7) of the water jacket; a second passage (13) communicating a jacket outlet (12) of the water jacket with the radiator; a water pump (15) provided in the first passage for feeding cooling water to the water jacket inlet; a third passage (16) branching off from a part (66) of the second passage to communicate the second passage with a part of the first passage located between the radiator and the water pump; a flow control valve (17) provided at least in one of the first passage, the second passage and the third passage for controlling a flow of the cooling water through the radiator; and a water temperature sensor (72) provided in a part of the second passage intermediate between the part of the second passage where the third passage branches off and the jacket outlet.

Because the water temperature sensor is provided in the part of the second passage intermediate between the branching part of the second passage and the jacket outlet, even when the flow rate of the cooling water flowing through the radiator should vary, changes in the mode of flow or the flow rate of the cooling water in the part where the water temperature sensor is located can be minimized.

In a preferred embodiment of the present invention, the engine cooling system further comprises a cavity (57) formed on a side face of the engine main body, the cavity communicating with the jacket outlet and the third passage formed in the engine main body, and a passage forming member (60) including a tube portion (61) and a lid portion (62) formed at an end of the tube portion and attached to the side face of the engine main body so as to close the cavity and jointly define a chamber, the tube portion internally defining a part of the second passage directly communicating with the chamber.

Thereby, the parts of the second passage and the third passage adjoining the branching part can be formed in a highly compact and economical way.

Preferably, the chamber is elongated from a first end communicating with the jacket outlet and a second end communicating with the third passage, and the part of the second passage defined by the tube portion communicates with a part of the chamber intermediate between the first end and the second end, the water temperature sensor being positioned adjacent to the first end of the chamber.

Thereby, the parts of the second passage and the third passage adjoining the branching part can be formed in a highly compact and economical way, and the positioning of the water temperature sensor is facilitated. In particular, the water temperature sensor may be positioned in a highly accessible part of the engine main body.

A part of the lid portion opposing the first end of the chamber may be formed with a recess (64) communicating with the part of the second passage defined by the tube portion.

The cooling water is enabled to flow from the chamber into the second passage defined in the tube portion via the recess so that the pressure loss of the cooling water flowing into the second passage can be minimized. Also, owing to the presence of the recess, the disturbance in the cooling water flowing into the second passage can be minimized so that the water temperature sensor is enabled to detect the temperature of the cooling water flowing out of the water jacket in a highly accurate manner.

An open end of the part of the second passage defined by the tube portion and facing the cavity may be laterally elongated.

The cooling water is thereby enabled to flow smoothly from the cavity to the second passage, and the pressure loss in this part can be minimized. The part of the cavity opposing the open end of the second passage should be properly configured to ensure such advantages.

The water temperature sensor may be supported by the lid portion and extend through the recess of the lid portion.

Thereby, the mounting structure for the water temperature sensor can be simplified.

The tube portion may extend generally upward from the lid portion.

According to this arrangement, the vaporized cooling water that may be fed to the second passage is allowed to travel upward along the part of the second passage defined by the tube portion. Therefore, the vaporized cooling water is prevented from remaining in the part surrounding the water temperature sensor so that the water temperature sensor is enabled to measure the liquid cooling water, instead of the vaporized cooling water, at all times.

The tube portion may include a base end portion extending substantially linearly from the lid portion and a free end portion extending from the base end portion along a curved path toward the radiator, a linear section of the base end portion of the tube portion being longer than a path of the cooling water in the cavity which the cooling water travels from the jacket outlet to the open end of the second passage.

Thereby, the cooling water is allowed to flow linearly in the upstream part of the second passage so that the pressure loss of the cooling water in the second passage can be minimized.

According to a preferred embodiment of the present invention, the cooling system further comprises a belt tensioner (76) including a support member (77) pivotally supported by the engine main body, a pulley (78) rotatably supported by a free end of the support member and engaging an auxiliary belt of the engine, a biasing member (79) urging the pulley toward the auxiliary belt, and a tensioner side marker (80) affixed to a part of the support member, wherein a lid portion side marker (81) is affixed to a part of the lid portion opposing the tensioner side marker such that an angular position of the support member relative to the engine main body may be determined by comparing positions of the two markers.

Thereby, the worker can readily determine the angular position of the support member without requiring any extra component part.

Preferably, the engine main body includes a cylinder block (21) formed with the jacket inlet and the jacket outlet, and a cylinder head (22) attached to the cylinder block, and the water jacket includes a block exhaust side water jacket (24) formed on an exhaust side of the cylinder block and communicating with the jacket inlet, a head water jacket (25) formed in the cylinder head and communicating with the block exhaust side water jacket, and a block intake side water jacket (26) formed on an intake side of the cylinder block and communicating with the jacket outlet and the head water jacket.

As the jacket outlet is directly formed by the cylinder block, the arrangement of the passages around the jacket outlet can be simplified.

In a preferred embodiment of the present invention, the block intake side water jacket includes an arcuate passage (52) extending along a circumference of a cylinder bore adjoining the jacket outlet, and a linear section of the base end portion of the tube portion extends in an intermediate direction between a radial direction and a tangential direction of the cylinder bore adjoining the jacket outlet.

Thereby, the cooling water discharged from the jacket outlet can flow with a minimum resistance and/or minimum disturbances.

The water temperature sensor may be configured to supply a signal indicating a cooling water temperature to a control unit of the engine (100).

Thereby, the engine control can be performed in a highly accurate manner so that the engine performance can be maximized and/or the fuel economy can be maximized.

BRIEF DESCRIPTION OF THE DRAWING(S)

Figure 9A:
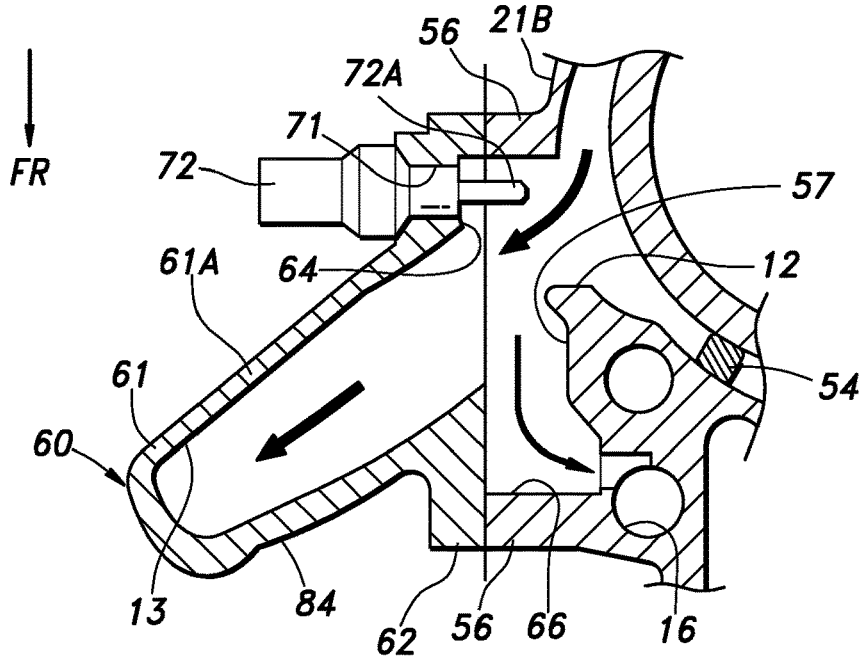
Figure 9B:
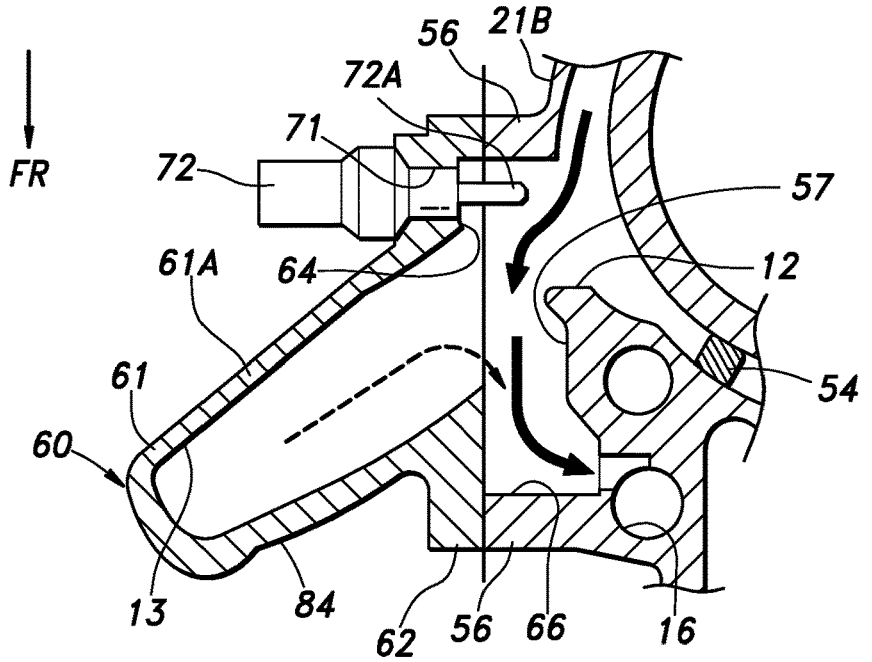

FIG. 9*a* illustrates the flow of the cooling water in a branching part of a second passage leading to a radiator when a flow control valve is open; and FIG. 9*b* illustrates the flow of the cooling water in the branching part of the second passage leading to a radiator when a flow control valve is closed.

DESCRIPTION OF THE PREFERRED EMBODIMENT(S)

A preferred embodiment of the present invention is described in the following with reference to the appended drawings.

Figure 1:
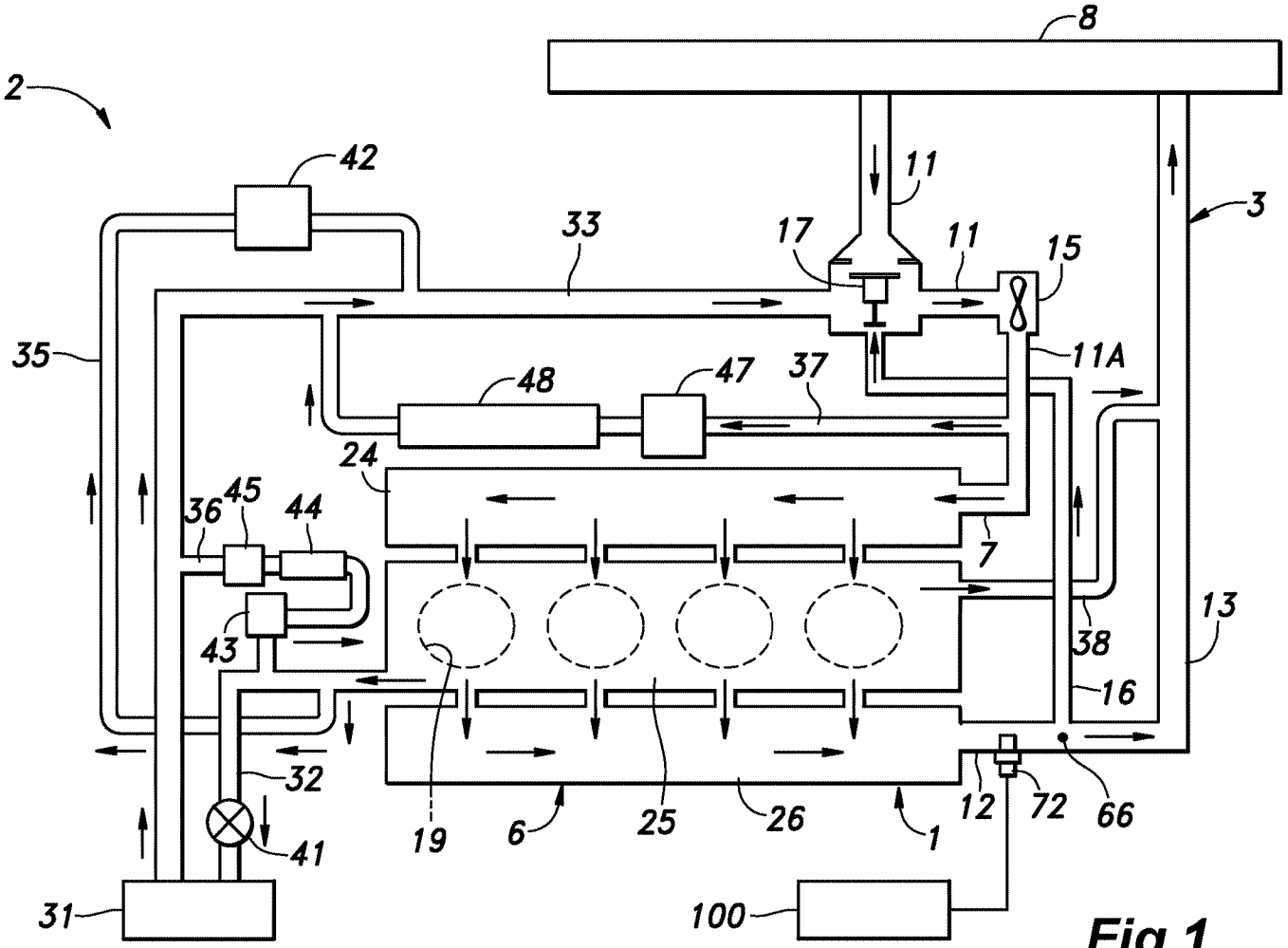
FIG. 1 is a diagram illustrating the passage structure of an engine cooling system embodying the present invention.

As shown in FIG. 1, the internal combustion engine 1 is provided with a cooling system 2 for cooling the engine 1 by exchanging heat with a cooling medium such as cooling water. The cooling system 2 includes a cooling water passage system 3 through which cooling water circulates. The cooling water passage system 3 includes a water jacket 6 formed in an engine main body 5, a first passage 11 communicating a radiator 8 positioned in front of the engine main body 5 with a jacket inlet 7 of the water jacket 6, a second passage 13 communicating a jacket outlet 12 of the water jacket 6 with the radiator 8, and a water pump 15 provided in the first passage 11 for forwarding the cooling water from the radiator 8 to the jacket inlet 7.

A flow control valve consisting of a thermostat valve 17 using wax and a spring member as a means of actuation is provided in a part of the first passage 11 located between the radiator 8 and the water pump 15 in such a manner that the flow of the cooling water out of the radiator 8 is blocked when the cooling water temperature is low, and the flow of the cooling water out of the radiator 8 is permitted when the cooling water temperature is high. Alternatively, the thermostat valve 17 may consist of a flow control valve which is regulated electrically or otherwise. A third passage 16 communicates a part (branching part 66) of second passage 13 with a part of the thermostat valve 17 in such a manner the cooling water drawn from the second passage 13 is conducted to an inlet end of the water pump 15 when the cooling water temperature is low, and the cooling water drawn from the second passage 13 is blocked from reaching the water pump 15 when the cooling water temperature is high.

Therefore, when the cooling water temperature is high, the cooling water discharged from the water jacket 6 is forwarded to the radiator 8, and is then forwarded back to the water jacket 6 once again. When the cooling water temperature is low, the cooling water discharged from the water jacket 6 is forwarded to the third passage 16, and is forwarded back to the water jacket 6 without passing through the radiator 8.

Figure 2:
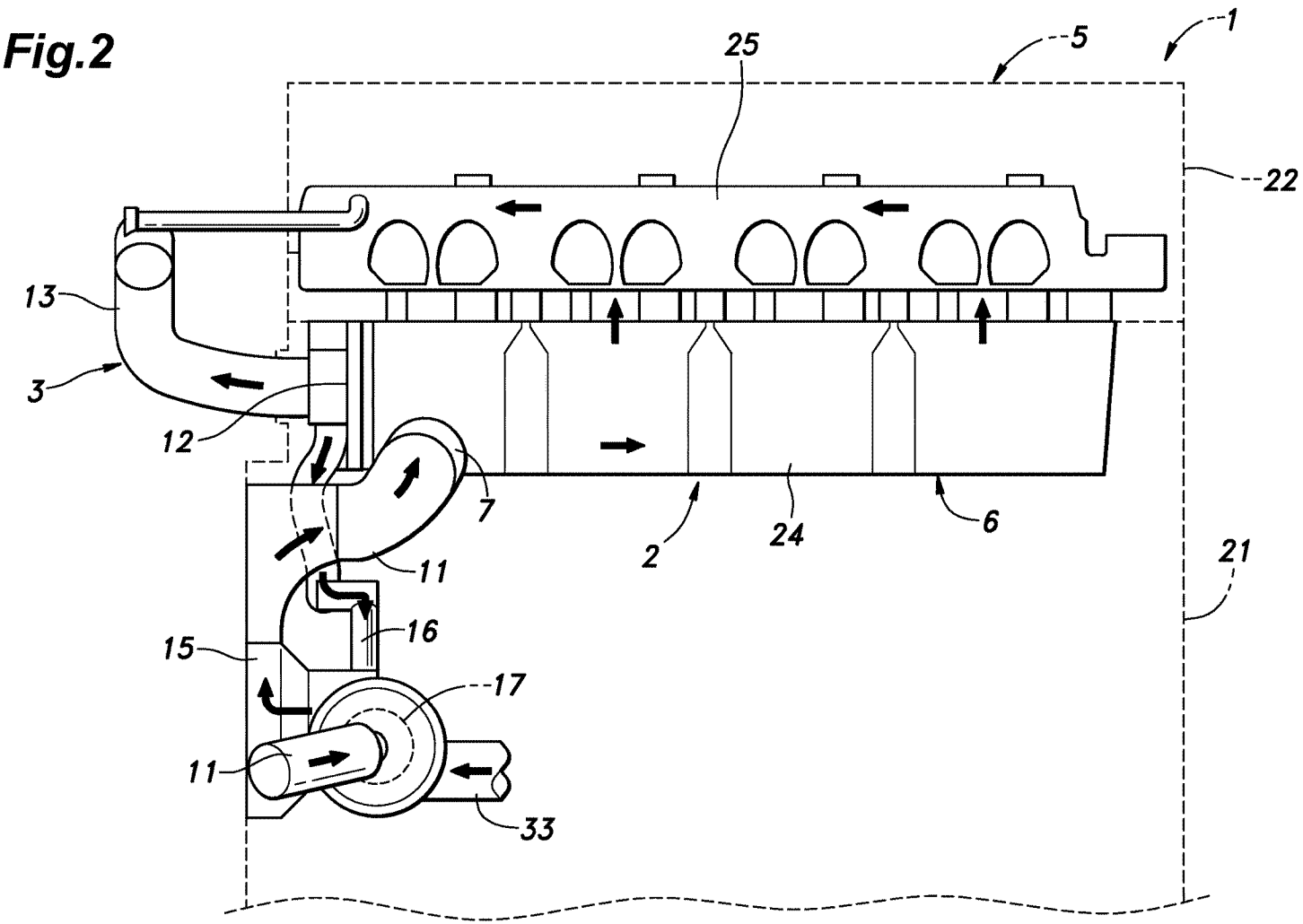
FIG. 2 is a front view of an engine main body illustrating the passage structure of the engine cooling system.
Figure 3:
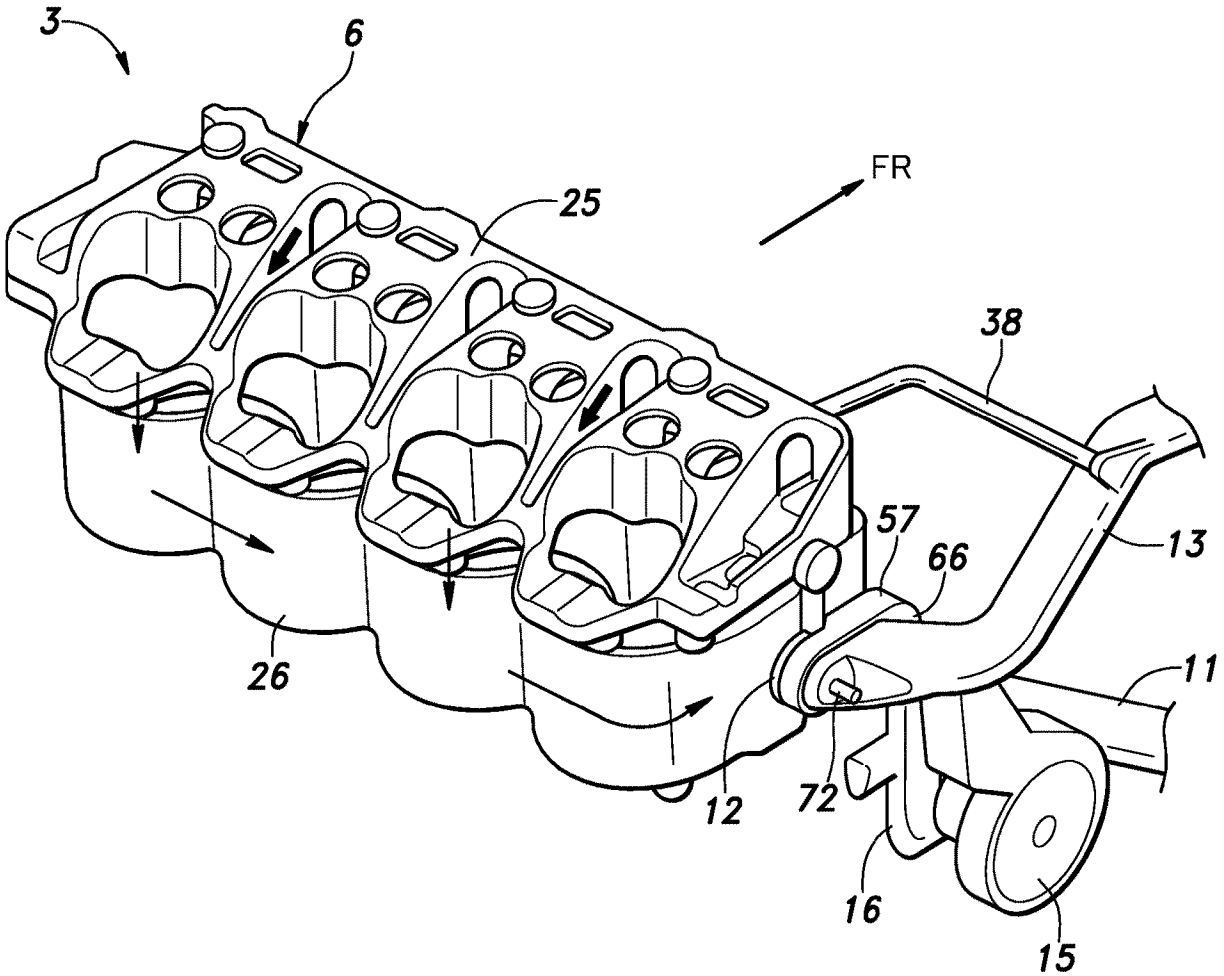
FIG. 3 is a perspective view of the engine main body illustrating the passage structure of the engine cooling system.
Figure 4:
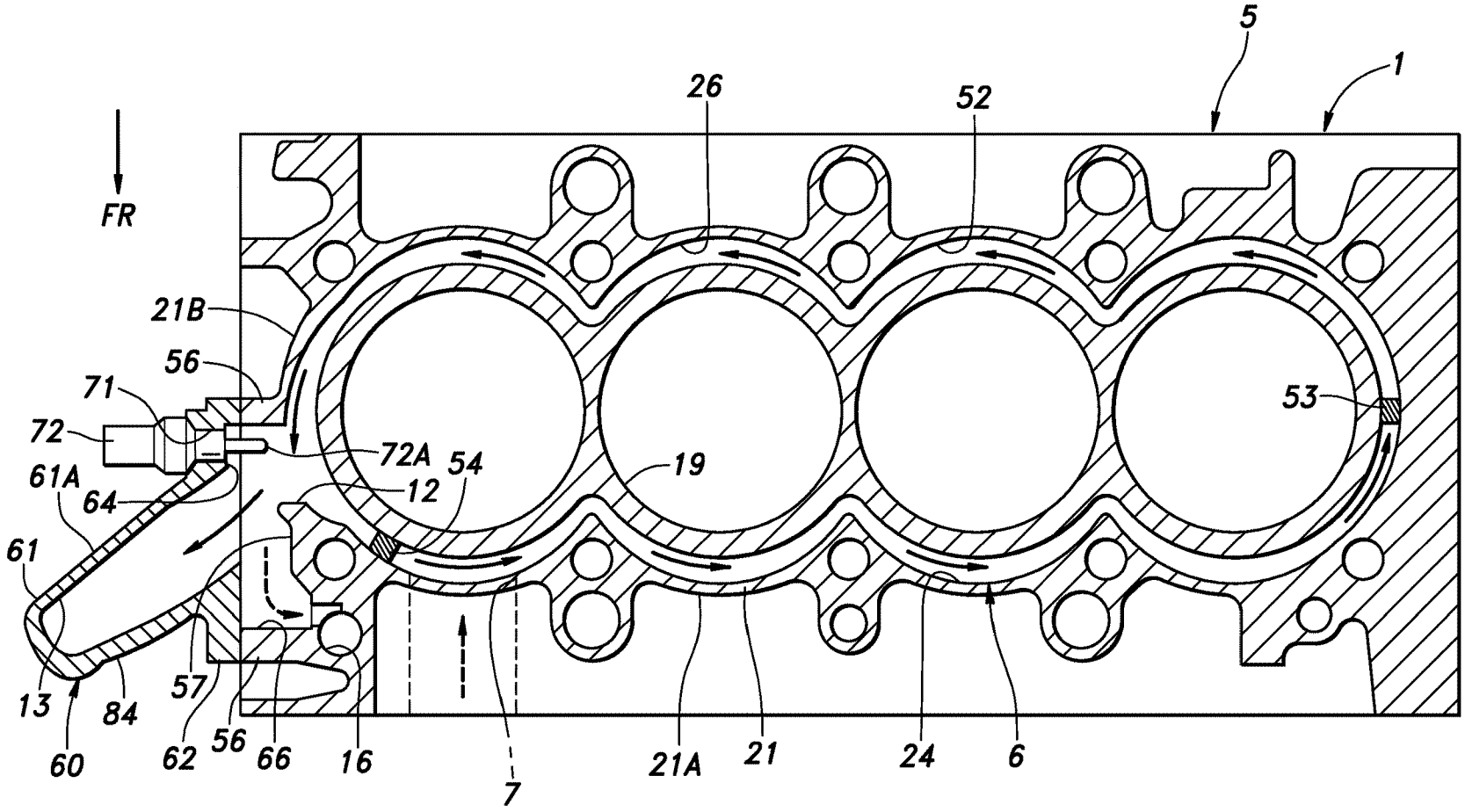
FIG. 4 is a sectional view of the engine main body.

As shown in FIGS. 2 to 4, the engine main body 5 includes a cylinder block 21 defining four cylinder bores 19 therein, and a cylinder head 22 is attached to the upper end of the cylinder block 21. In the illustrated embodiment, the engine main body 5 is disposed laterally in an engine room of the vehicle with an exhaust side thereof facing forward and an intake side thereof facing rearward. The water jacket 6 includes a block exhaust side water jacket 24 formed on the exhaust side of the cylinder block 21, a block intake side water jacket 26 formed on the intake side of the cylinder block 21, and a head water jacket 25 formed in the cylinder head 22 and communicating with the block exhaust side water jacket 24 and the block intake side water jacket 26. The jacket inlet 7 directly communicates with the block exhaust side water jacket 24, and the jacket outlet 12 directly communicates with the block intake side water jacket 26. Therefore, the cooling water introduced from the jacket inlet 7 is passed into the block exhaust side water jacket 24, the head water jacket 25 and the block intake side water jacket 26, in that order, before being discharged from the jacket outlet 12.

As shown in FIG. 1, the cooling water passage system 3 further includes a heater 31 for warming the cabin, a heater supply passage 32 connected between the heater 31 and the head water jacket 25 and provided with a heat flow control valve 41, a heater discharge passage 33 connected between the heater 31 and a part of the first passage 11 located between the thermostat valve 17 and the water pump 15, a first bypass passage 35 and a second bypass passage 36 connected between the heater supply passage 32 and the heater discharge passage 33 in a mutually parallel relationship, a third bypass passage 37 connected between a part of the first passage 11 located between the water pump 15 and the jacket inlet 7 and the heater discharge passage 33, and an air purge passage 38 connected between the head water jacket 25 and the second passage 13.

An ATF cooler 42 is provided in the first bypass passage 35 so that the cooling water flowing through the first bypass passage 35 exchanges heat with the ATF flowing through the ATF cooler 42. In the second bypass passage 36, a high pressure EGR valve 43, a breather passage 44, and a low pressure EGR valve 45 are provided in that order from the side of the heater supply passage 32, and the cooling water flowing through the second bypass passage 36 exchanges heat with the EGR gas and the blow-by gas flowing through the corresponding parts or devices. In the third bypass passage 37, an oil cooler 47 and a low pressure EGR cooler 48 are provided in that order from the side of the first passage 11, and the cooling water flowing through the third bypass passage 37 exchanges heat with the lubricating oil and the EGR gas flowing through the corresponding parts or devices.

As shown in FIGS. 2 and 3, a part of the first passage 11 is formed in the cylinder block 21. The connecting portion between the first passage 11 and the third passage 16 (in particular a part adjoining the thermostat valve 17), the connecting portion between the first passage 11 and the heater discharge passage 33, and the water pump 15 are formed at least partly by the cylinder block 21.

As shown in FIG. 4, a continuous arcuate passage 52 is formed in the cylinder block 21 along the outer peripheral portions of the cylinder bores 19. The arcuate passage 52 opens out at the fastening surface between the cylinder block 21 and the cylinder head 22, and communicates with the head water jacket 25. The jacket outlet 12 which also communicates with the arcuate passage 52 is formed in the right end of the cylinder block (the left end side in FIG. 4). A first plug 53 that partitions the arcuate passage 52 is inserted into one end of the arcuate passage 52 remote from the jacket outlet 12 with respect to the cylinder row direction. A second plug 54 that partitions the arcuate passage 52 is inserted in a part of the arcuate passage 52 adjacent to the jacket outlet 12 and on the exhaust side of the cylinder block 21. Thus, the first plug 53 and the second plug 54 separate the arcuate passage 52 into the block exhaust side water jacket 24 (on the front side of the vehicle) and the block intake side water jacket 26 (on the rear side of the vehicle). The block intake side water jacket 26 extends to and along the end part of the cylinder block 21 with respect to the cylinder row direction, and communicates with the jacket outlet 12 extending from the end part of the cylinder block 21.

Around the jacket outlet 12 on the right end of the cylinder block 21, an annular rib 56 protrudes away from the end surface. The free end of the annular rib 56 defines a flush surface, and a cavity 57 elongated in the fore and aft direction is defined inside the annular rib 56. The jacket outlet 12 opens out at a rear end part of the cavity 57, and the other (front) end of the cavity 57 is connected to the third passage 16. The third passage 16 is formed in the cylinder block 21 so as to extend downward from the front end of the cavity 57 and is connected to a part of the first passage 11 formed in the cylinder block 21.

Figure 5:
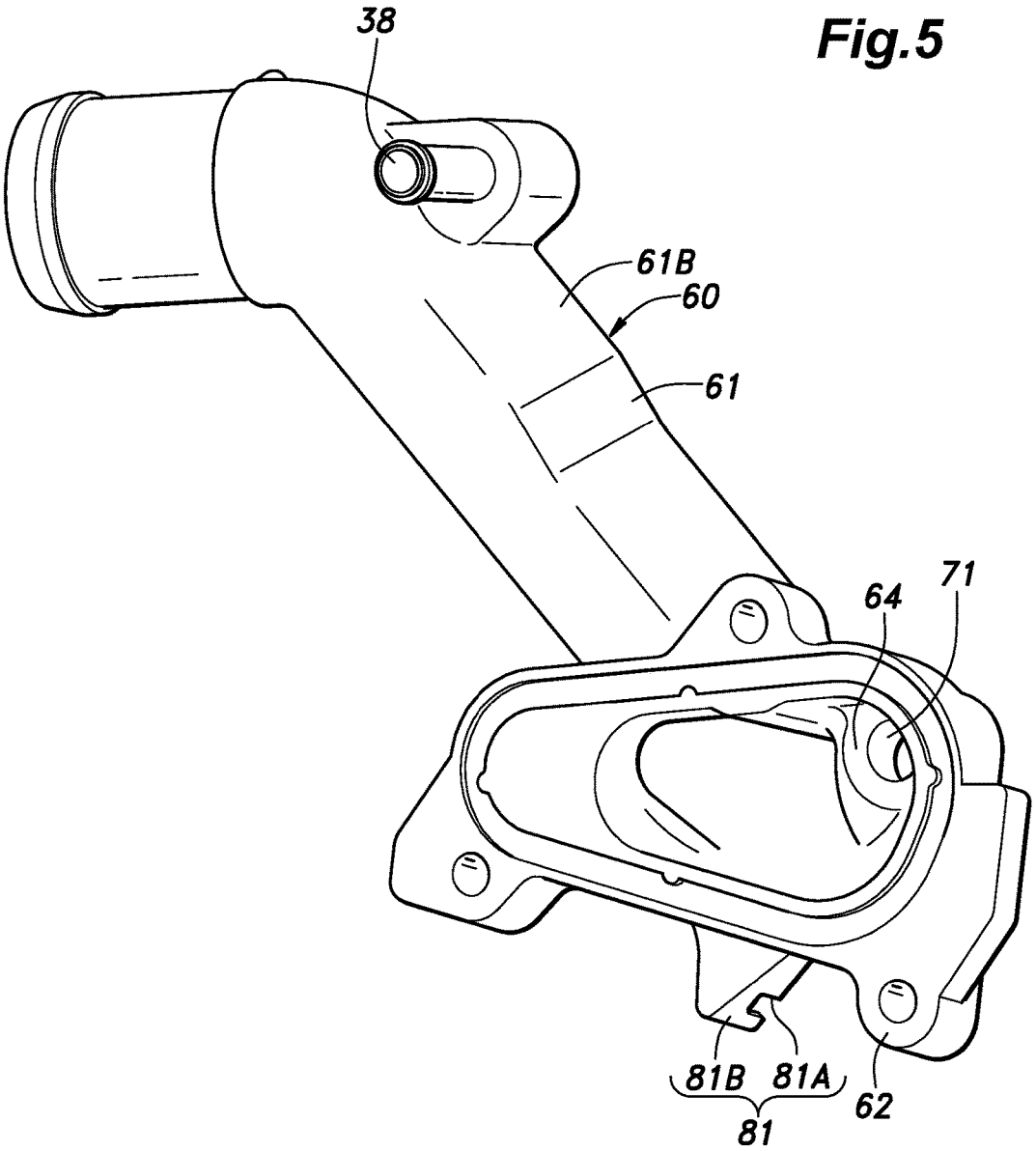
FIG. 5 is a perspective view of a passage forming member.
Figure 6:
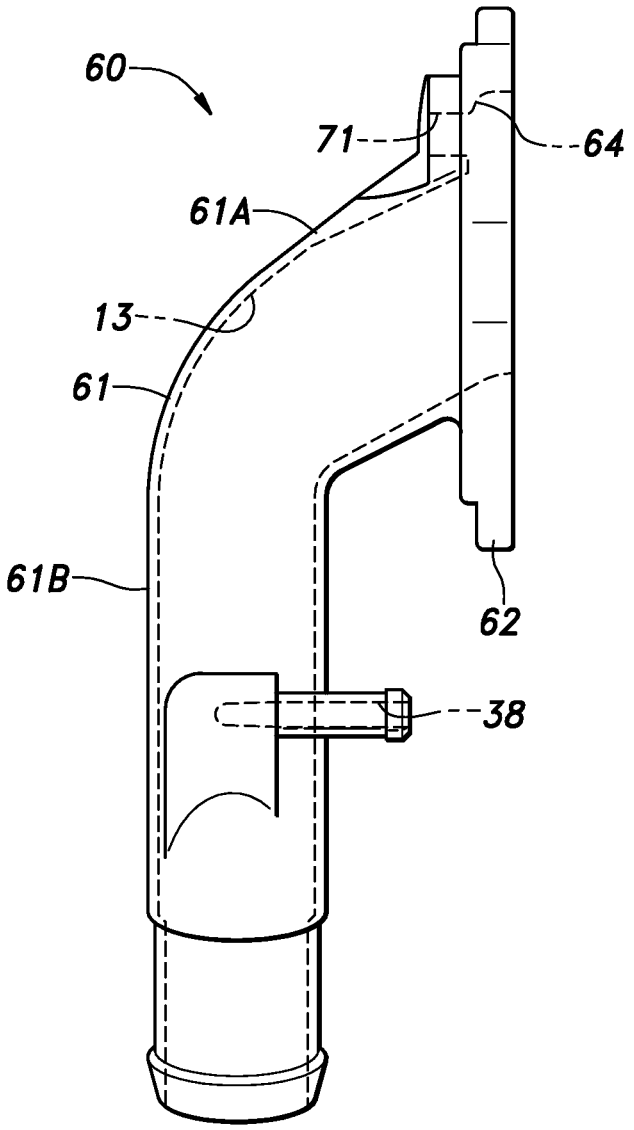
FIG. 6 is a plan view of the passage forming member.

A passage forming member 60 is fastened to the free end of the annular rib 56. As shown in FIGS. 4 to 6, the passage forming member 60 includes a tube portion 61 and a disk shaped lid portion 62 integrally connected to an end of the tube portion 61. The lid portion 62 is configured to close the cavity 57, and is fastened to the protruding free end of the annular rib 56 via a seal member along the outer peripheral portion thereof. The cavity 57, the lid portion 62, and the tube portion 61 form a part of the second passage 13 on the side of the jacket outlet 12.

An open end of the tube portion 61 on the side of the lid portion 62 is disposed in a middle part of the cavity 57 with respect to the lengthwise direction thereof, or between the rear end and the front end of the cavity 57. A recess 64 having a concave configuration is formed in a part of the lid portion 62 opposing a rear end part of the cavity 57. The recess 64 extends toward the tube portion 61, and a bottom part of the recess 64 is connected to the inner peripheral surface of the tube portion 61 at the open end thereof. The recess 64 cooperates with the inner peripheral surface of the tube portion 61 to form an elongated circular open end elongated in the fore and aft direction. More specifically, the recess 64 extends the open end of the tube portion 61 rearward. The space defined by the rear part of the cavity 57 and the rear part of the lid portion 62 forms a part of the second passage 13 in cooperation with the interior of the tube portion 61. The space defined by the front part of the cavity 57 and the front part of the lid portion 62 forms the branching part 66 at which the third passage 16 branches off from the second passage 13.

The tube portion 61 has a base end portion 61A directly extending from the lid portion 62 and a free end portion 61B which is bent with respect to the main part of the tube portion 61 and extends forward to the side of the radiator 8. The base end portion 61A of the tube portion 61 linearly extends from the lid portion 62 away from the cylinder block 21 (rightward) and away from the jacket outlet 12 (forward). As the base end portion 61A extends obliquely forward and rightward, the open end of the tube portion 61 at the lid portion 62 squarely faces the jacket outlet 12 so that the bend angle of the water flow discharged from the jacket outlet 12 and directed into the tube portion 61 can be minimized. In other words, the flow line of the cooling water flowing from the jacket outlet 12 to the tube portion 61 via the recess 64 can be made highly linear.

Along the center line of the base end portion 61A of the tube portion 61, the distance by which the cooling water travels through a linear section of the base end portion 61A of the tube portion 61 is substantially longer than the distance the cooling water travels through the cavity 57. The length of the cavity 57 in the direction along the center line of the base end portion 61A is given as the distance from the open end of the jacket outlet 12 to the open end of the base end portion 61A of the tube portion 61 at the lid portion 62. As a result, the linear passage extending from the jacket outlet 12 to the bent free end portion 61B of the tube portion is extended so that the pressure loss of the cooling water flowing in the tube portion 61 is minimized.

Also, with respect to the arcuate passage 52 extending along a circumference of the cylinder bore 19 adjoining the jacket outlet 12, the linear section of the base end portion 61A of the tube portion 61 extends in an intermediate direction between a radial direction and a tangential direction of the cylinder bore 19 adjoining the jacket outlet 12. Thereby, the cooling water discharged from the jacket outlet 12 can flow with a minimum resistance and/or minimum disturbances.

The free end portion 61B of the tube portion 61 extends forward (away from the jacket outlet 12 in the lengthwise direction of the cavity 57) and upward from the base end portion 61A of the tube portion 61. The terminal end of the free end portion 61B of the tube portion 61 is connected to the radiator 8 via a hose or piping. An end of the air purge passage 38 is connected to the free end portion 61B of the tube portion 61. Preferably, the air purge passage 38 is connected to the free end portion 61B of the tube portion 61 at a relatively high position. The air purge passage 38 may be formed by a hose or the like connected between the cylinder head 22 and the passage forming member 60.

As shown in FIGS. 4 and 5, a sensor mounting hole 71 penetrating the lid portion 62 in the thickness-wise direction is formed in a rear part of the lid portion 62. A water temperature sensor 72 is inserted and supported in the sensor mounting hole 71. The water temperature sensor 72 may be a per se known temperature sensor such as a thermistor. The signal from the water temperature sensor 72 is forwarded to a control unit 100 (FIG. 1) for controlling the air-fuel ratio, the ignition timing, the radiator fan speed, etc. based on the signal from the water temperature sensor 72.

As shown in FIG. 4, the water temperature sensor 72 extends through the recess 64, and a detection portion 72A at the tip of the water temperature sensor 72 is disposed in a rear end part of the cavity 57. More specifically, the detection portion 72A of the water temperature sensor 72 is disposed at a position directly facing the jacket outlet 12 in the cavity 57. The water temperature sensor 72 is arranged in a part of the second passage 13 located closer to the side jacket outlet 12 than the branching part 66 is. In addition, the water temperature sensor 72 is disposed at a position in the cavity 57 which is closer to the jacket outlet 12 than the branching part 66 and the open end of tube portion 61 are.

Figure 7:
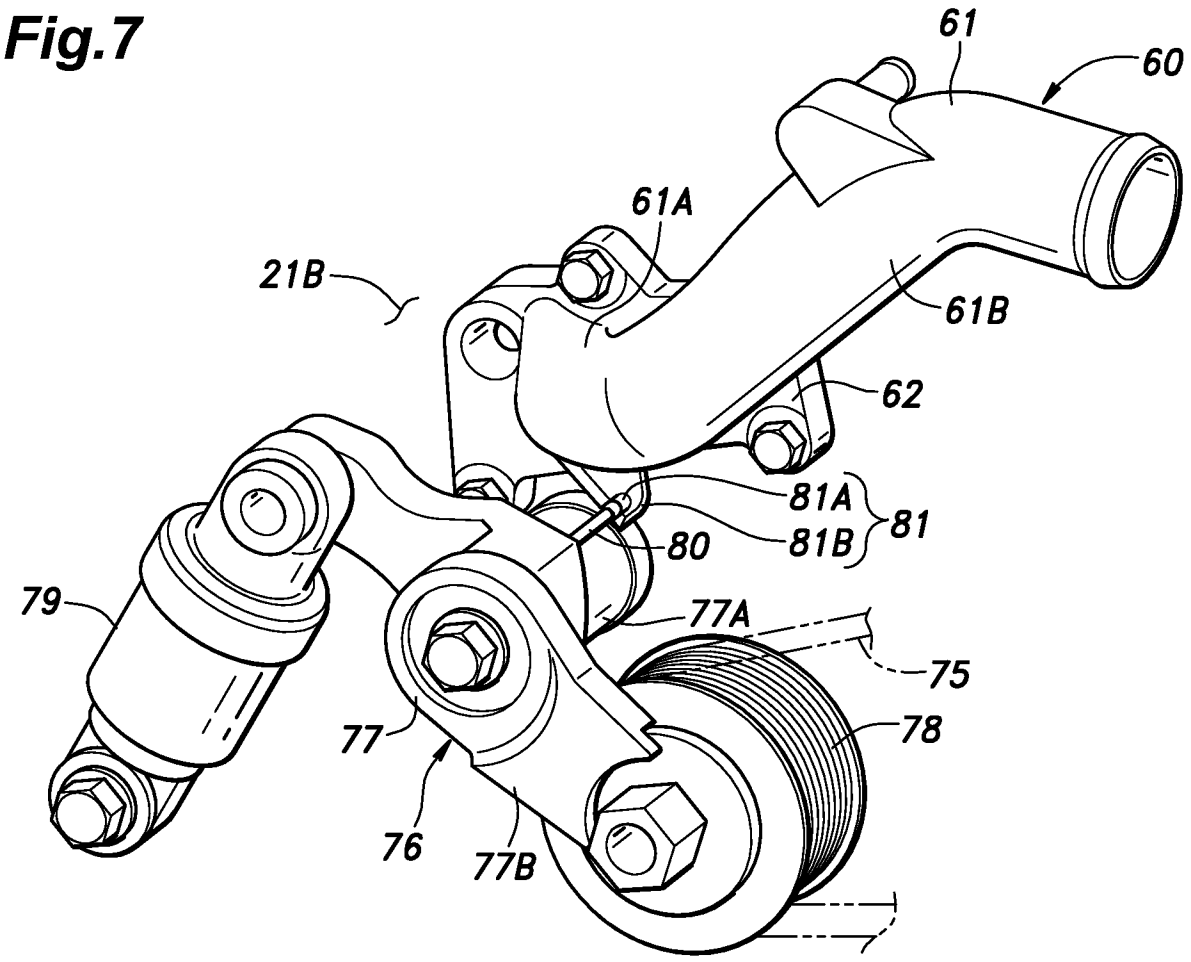
FIG. 7 is a perspective view showing the passage forming member and an adjoining belt tensioner.

As shown in FIG. 7, a belt tensioner 76 for applying a predetermined tension to an accessory belt 75 is provided on the right end face 21B of the cylinder block 21. The accessory belt 75 is passed around a crank pulley provided on the crankshaft (not shown the drawings) and a pulley (not shown the drawings) provided on a drive shaft of the water pump 15. The accessory belt 75 may additionally be passed around an accessory pulley of an accessory device such as an alternator. The belt tensioner 76 comprises a support member 77 rotatably supported on the right end face 21B of the cylinder block 21 at a base end thereof, an idler pulley 78 rotatably supported by a free end of the support member 77 and engaging the accessory belt 75, and a biasing device 79 provided between the cylinder block 21 and the support member 77 to urge the support member 77 in a predetermined rotational direction.

The support member 77 is provided with a shaft portion 77A pivotally supported by the cylinder block 21, a support arm 77B extending radially from the shaft portion 77A. The idler pulley 78 is rotatably supported by a free end of the support arm 77B. The support member 77 is disposed under the passage forming member 60.

A tensioner side marker 80 is affixed to a base end part of the support arm 77B facing upward. The tensioner side marker 80 consists of a rib in the illustrated embodiment, but may also consist of any visible mark such as a notch, a groove and a painted marking.

A lid side marker 81 is provided in a lower edge part of the outer surface of the lid portion 62 located under the base end portion 61A of the tube portion 61 so as to correspond to the tensioner side marker 80. The tensioner side marker 80 consists of a projection 81B provided with a notch 81A in the illustrated embodiment, but may consist of any visible mark such as a notch, a groove and a painted marking. From the relative position between the lid side marker 81 and the tensioner side marker 80, the angular position of the support arm 77B can be determined.

The worker can determine the angular position of the support arm 77B of the belt tensioner 76 by visually confirming the relative position of the tensioner side marker 80 with respect to the lid side marker 81. When the accessory belt 75 stretches, the angular position of the support arm 77B changes from the initial position.

Figure 8:
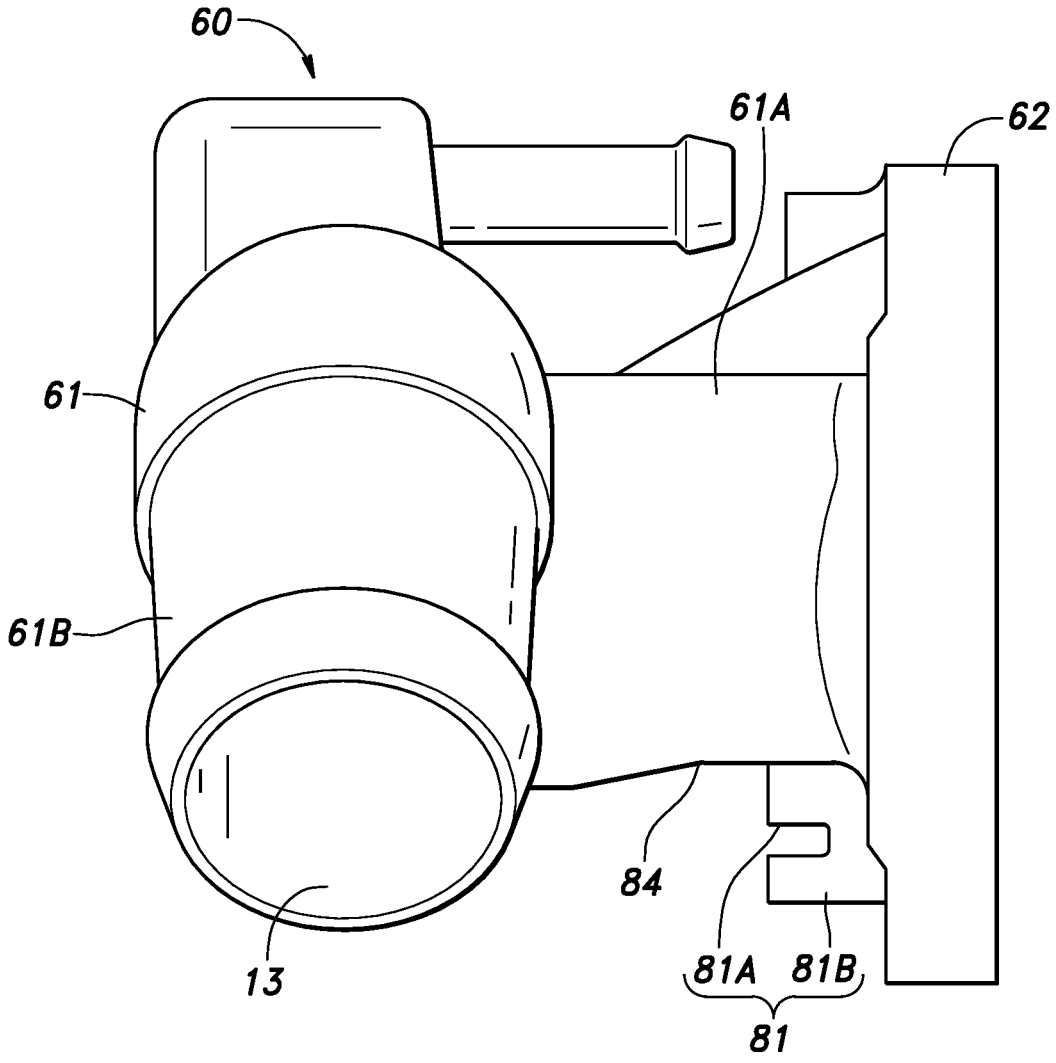
FIG. 8 is a plan view of the passage forming member.

Since the base end portion 61A of the tube portion 61 extends from the lid portion 62 away from the cylinder block 21 (rightward), a space is created between the free end portion 61B of the tube portion 61 and the end face 21B of the cylinder block 21 so that the lid side marker 81 provided on the lower edge portion of the lid portion 62 is visible from above. As shown in FIG. 8, a recess 84 is formed in the front lower portion of the outer peripheral surface of the base end portion 61A of the tube portion 61. The recess 84 is provided for the purpose of allowing the worker looking down on the engine 1 from the front and above the engine 1 to see the tensioner side marker 80 and the lid side marker 81 with ease. The recess 84 is formed in such a size that an imaginary line connecting the eyes of the worker standing in front of the engine room and the lid side marker 81 is not obstructed by the base end portion 61A of the tube portion 61.

The mode of operation of the cooling system 2 of the engine 1 according to the present embodiment configured as described above will be described in the following. When the temperature of the cooling water is lower than a predetermined temperature, the thermostat valve 17 shuts off the communication between the first passage 11 and the radiator 8. In this state, the cooling water circulates through the first passage 11, the water jacket 6, the second passage 13, and the third passage 16, and returns to the first passage 11, under the action of the water pump 15. On the other hand, when the temperature of the cooling water is higher than the predetermined temperature, the thermostat valve 17 causes the first passage 11 and the radiator 8 to communicate with each other. In this state, the cooling water flows through the first passage 11, the water jacket 6, the second passage 13, and the radiator 8, and returns to the first passage 11 under the action of the water pump 15.

In the second passage 13 connected to the jacket outlet 12, since the water temperature sensor 72 is provided closer to the jacket outlet 12 than the branching part 66 or the junction between the second passage 13 and the third passage 16 is, even when the flow rate of the cooling water flowing into the radiator 8 changes, the changes in the condition of the flow of the cooling water flowing through the part where the water temperature sensor 72 is located are minimized.

As shown in FIG. 9*a*, in a state where the cooling water is permitted to flow into the radiator 8, the cooling water flowing out from the jacket outlet 12 passes through the rear portion of the cavity 57 and forwarded to the tube portion 61. At this time, since a part of the cooling water passes through the recess 64 before flowing to the tube portion 61, the cooling water flows from the jacket outlet 12 to the tube portion 61 along a substantially straight path so that the pressure loss in the second passage 13 is minimized.

As the recess 64 formed in the lid portion 62 creates a space jointly with the rear end of the cavity 57 in such a manner that this space is laterally offset relative to the linear path of the cooling water extending between the jacket outlet 12 and the tube portion 61, and a water temperature sensor 72 is position in this recess 64, the water temperature sensor 72 does not disturb the flow of the cooling water, and the pressure loss is minimized. Further, since the tube portion 61 extends upward from the side of the lid portion 62 to the side of the free end portion 61B of the tube portion 61, even when the steam generated by the evaporation of the cooling water enters a part of the cavity 57 defining the second passage 13, the steam is conducted to the radiator 8 along an upwardly extending path. Therefore, the steam does not stay in the part where the water temperature sensor 72 is located so that the temperature sensor 72 is prevented from measuring the temperature of the steam, as opposed to the liquid part of the cooling water.

As shown in FIG. 9*b*, when the cooling water is prevented from flowing into the radiator 8, the cooling water passes from the jacket outlet 12 to the third passage 16 via the rear part of the cavity 57 and the branching part 66. Since the recess 64 is formed in the area facing the jacket outlet 12, the passage leading to the rear end of the cavity 57 and the lid portion 62 is expanded so that the cooling water is allowed to flow smoothly from the jacket outlet 12 to the front part of the cavity 57 via an upstream end part of the second passage 13, and the pressure loss in the space defined by the cavity 57 and the lid portion 62 is minimized.

As shown in FIGS. 9*a* and 9*b*, the water temperature sensor 72 is disposed at a position where the cooling water always flows without regard to if the cooling water is circulated in the radiator 8 or not. Therefore, without regard to the condition of the flow of the cooling water in the radiator 8, the temperature sensor 72 is able to detect the temperature of the cooling water accurately.

Furthermore, as shown in FIG. 9*b*, even in the case where the flow of the cooling water to the radiator 8 is prohibited, and the cooling water cooled by the radiator 8 flows backward, the cooling water flowing back from the radiator 8 is pushed by the main flow of the cooling water toward the branching part 66 and the third passage 16, and is prevented from flowing to the rear end of the cavity 57 where the water temperature sensor 72 is positioned. Therefore, the temperature detected by the water temperature sensor 72 is prevented from being disturbed by the cooling water flowing back from the radiator 8.

Since the passage forming member 60 is fastened to the cylinder block 21, and the second passage 13 along with the junction (branching part 66) between the second passage 13 and the third passage 16 is formed by a part of the cavity 57 in cooperation with the passage forming member 60, the second passage 13 can be formed in a both simple and compact manner. In addition, since the water temperature sensor 72 is supported by the passage forming member 60, the work involved in installing the water temperature sensor 72 is simplified.

Although the present invention has been described in terms of a preferred embodiment thereof, it is obvious to a person skilled in the art that various alterations and modifications are possible without departing from the scope of the present invention. For example, in the foregoing embodiment, the annular rib 56 is provided on the end face 21B of the cylinder block 21, and the cavity 57 is formed by recessing the part of the cylinder block 21 surrounded by the annular rib 56. However, the annular rib 56 may be omitted so that the cavity 57 is formed solely by recessing the end face 21B of the cylinder block 21.

Further, the configuration of the water jacket 6 of the illustrated embodiment is only an example, and can be appropriately modified. For example, the jacket inlet 7 may be provided in the block intake side water jacket 26 and the jacket outlet 12 may be provided in the block exhaust side water jacket 24. Further, the ATF cooler 42, the high pressure EGR valve 43, the breather passage 44, the low pressure EGR valve 45, the low pressure EGR cooler 48, etc. provided in the cooling system 2 are not indispensable for the present invention and may be appropriately omitted and substituted without departing from the spirit of the present invention.

The invention claimed is:

1. An engine cooling system, comprising:

a water jacket formed on a main body of an internal combustion engine;

a first passage communicating a radiator with a jacket inlet of the water jacket;

a second passage communicating a jacket outlet of the water jacket with the radiator;

a water pump provided in the first passage for feeding cooling water to the water jacket inlet;

a third passage communicating a part of the first passage located between the radiator and the water pump with the second passage;

a flow control valve provided at least in one of the first passage, the second passage and the third passage for controlling a flow of the cooling water through the radiator;

a water temperature sensor provided in the second passage intermediate between a branch part of the second passage where the third passage branches off and the jacket outlet;

a cavity formed on a side face of the engine main body; and a passage forming member including a lid portion closing the cavity;

wherein the cavity extends from one end connected to the jacket outlet to another end connected to the third passage, and the cavity and the passage forming member define a part of the second passage, the water temperature sensor being positioned in the one end of the cavity.

2. The engine cooling system according to claim 1, wherein the passage forming member includes a tube portion, and the lid portion is formed on an outer periphery of an end of the tube portion, an open end of the tube portion adjacent to the cavity being positioned between the one end and the other end of the cavity.

3. The engine cooling system according to claim 2, wherein a part of the lid portion opposing the one end of the cavity is formed with a recess communicating with the part of the second passage defined by the tube portion.

4. The engine cooling system according to claim 3, wherein the open end of the tube portion adjacent to the cavity defines an elongated circular shape in cooperation with the recess.

5. The engine cooling system according to claim 4, wherein the water temperature sensor is supported by the lid portion and extends through the recess.

6. The engine cooling system according to claim 2, wherein the tube portion extends generally upward from the lid portion toward a free end of the tube portion.

7. The engine cooling system according to claim 2, wherein the tube portion includes a base end portion extending substantially linearly from the lid portion and a free end portion extending from the base end portion along a curved path toward the radiator, an open end of the base end portion at the lid portion facing the jacket outlet, and the base end portion being longer than the cavity in length.

8. The engine cooling system according to claim 7, further comprising a belt tensioner attached to a side of the engine main body for applying a prescribed tension to an auxiliary belt, the belt tensioner including a support member pivotally supported by the side of the engine main body, a pulley rotatably supported by the support member and engaging the auxiliary belt, an urging device urging the support member toward the auxiliary belt, and a tensioner side marker affixed to an outer part of the support member, wherein a lid portion side marker is affixed to an outer side of the lid portion in a lower part of the base end portion such that a position of the tensioner side marker relative to the lid portion may be determined, and a lower part of an outer periphery of the base end portion is provided with a recess which is recessed inward.

9. The engine cooling system according to claim 2, wherein the engine main body includes a cylinder block formed with the jacket inlet and the jacket outlet, and a cylinder head attached to the cylinder block, and the water jacket includes a block exhaust side water jacket formed on an exhaust side of the cylinder block and communicating with the jacket inlet, a head water jacket formed in the cylinder head to extend from an exhaust side to an intake side thereof and communicating with the block exhaust side water jacket, and a block intake side water jacket formed on an intake side of the cylinder block and communicating with the jacket outlet and the head water jacket.

* * * * *